United States Patent [19]

Flickinger et al.

[11] Patent Number: 4,656,956

[45] Date of Patent: Apr. 14, 1987

[54] FURNACE WITH OSCILLATING GRATE

[76] Inventors: Dale M. Flickinger, Box 434, Spicer, Minn. 56288; Mark D. Flickinger, Box 137, Aneta, N. Dak. 58212

[21] Appl. No.: 846,052

[22] Filed: Mar. 31, 1986

Related U.S. Application Data

[62] Division of Ser. No. 653,680, Sep. 21, 1984, Pat. No. 4,598,651.

[51] Int. Cl.[4] ..... F23B 7/00

[52] U.S. Cl. ..... 110/233; 110/257; 110/310; 110/318; 126/77; 126/104 R; 126/112

[58] Field of Search ..... 110/208, 210–211, 110/214, 233, 235, 249, 254–255, 257–258, 267–268, 281–284, 278, 301–302, 309–310, 317–318, 326–327; 126/67, 77, 83, 112

[56] References Cited

U.S. PATENT DOCUMENTS

| | | | |
|---|---|---|---|
| 505,748 | 9/1893 | Campbell | 110/282 |
| 527,453 | 10/1894 | Richards | 110/281 |
| 613,289 | 11/1898 | Miller | 110/300 |
| 703,068 | 6/1902 | King . | |
| 795,388 | 7/1905 | Googins | 110/281 |
| 804,457 | 11/1905 | Cox | 110/281 |
| 1,186,971 | 6/1916 | Davis | 110/282 |
| 1,403,609 | 1/1922 | Leonard et al. | 110/282 |
| 1,644,953 | 10/1927 | Seyboth | 110/281 |
| 2,119,937 | 6/1938 | Banfield | 110/287 |
| 2,137,158 | 11/1938 | Douglass . | |
| 2,294,269 | 8/1942 | Bennett | 110/282 |
| 3,413,938 | 12/1968 | Dvirka . | |
| 4,007,697 | 2/1977 | Prill . | |
| 4,103,627 | 8/1978 | Mainka | 110/281 |
| 4,141,336 | 2/1979 | Fitch | 126/77 X |
| 4,170,183 | 10/1979 | Cross | 110/257 X |
| 4,172,425 | 10/1979 | Sheridan | 110/257 |
| 4,319,557 | 3/1982 | Sietmann et al. | 126/77 X |
| 4,385,620 | 5/1983 | Black | 126/77 |
| 4,471,704 | 9/1984 | John et al. | 110/257 X |
| 4,517,903 | 5/1985 | Richmond et al. | 110/233 |

*Primary Examiner*—Albert J. Makay
*Assistant Examiner*—Steven E. Warner
*Attorney, Agent, or Firm*—Kinney & Lange

[57] ABSTRACT

A solid fuel furnace having an oscillating grate plate solid fuel burner therein wherein the grate plates are in a stepped arrangement and every other plate moves together, in an opposite direction from the adjacent plates so that the solid fuel is kept moving down the step grate positively. Additionally, the solid fuel burner is mounted in a furnace housing which is designed to utilize the hot combustion gases to preheat incoming or makeup air for a blower used for supply air flow for heating. Baffles are used to provide a substantially elongated path for the combustion gases to ensure adequate heat exchange in a compact space.

6 Claims, 8 Drawing Figures

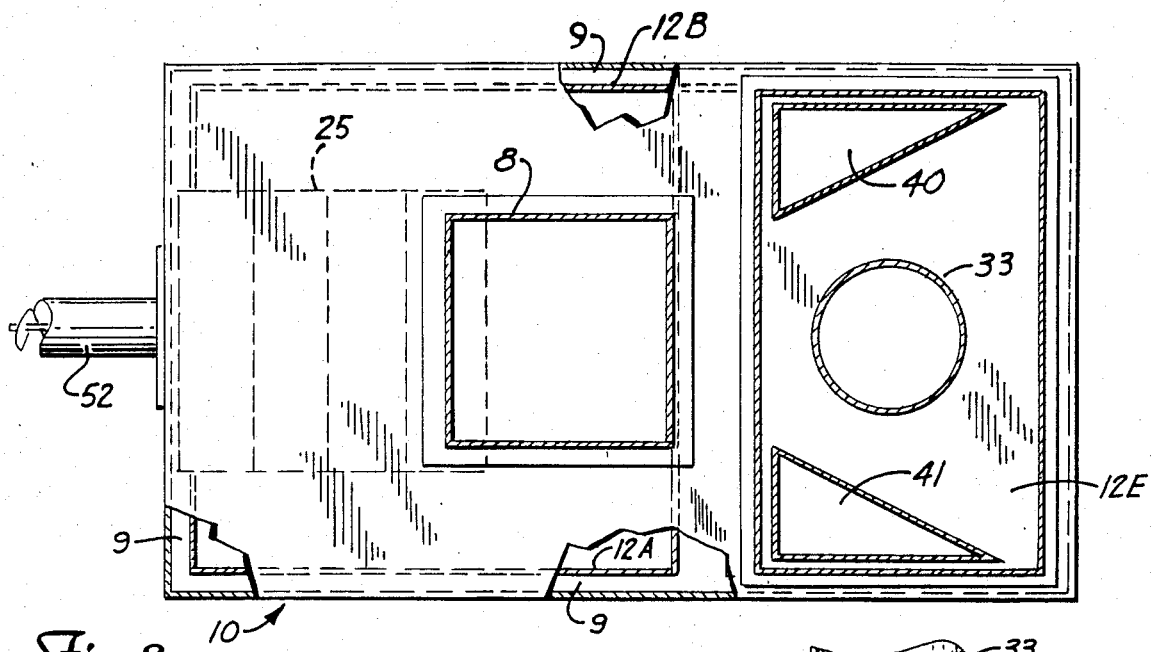
Fig. 2
Fig. 1
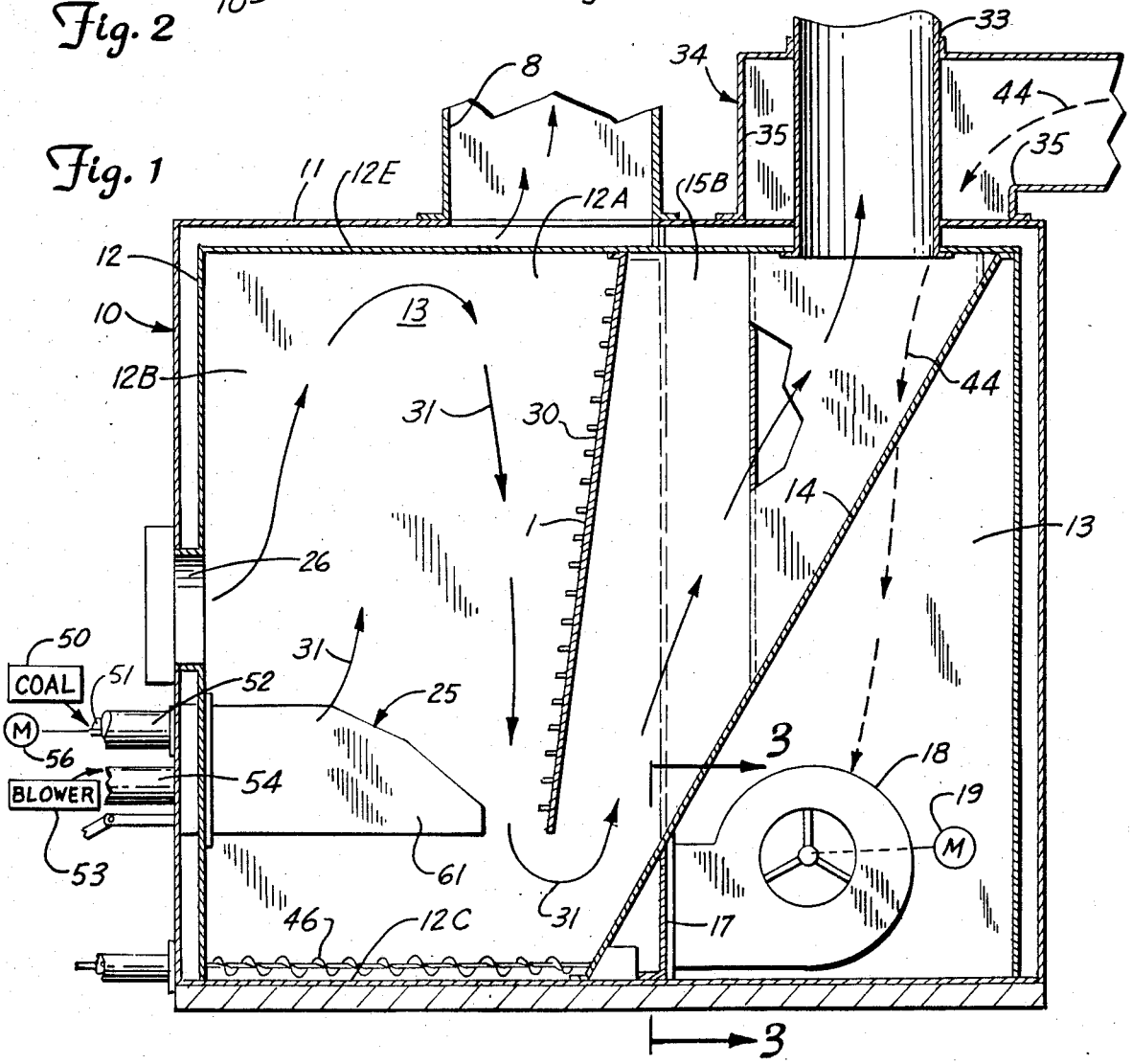

FURNACE WITH OSCILLATING GRATE

This is a division of application Ser. No. 653,680, filed Sept. 21, 1984, now U.S. Pat. No. 4,598,651.

BACKGROUND OF THE INVENTION

1. Field of the Invention

The present invention relates to a solid fuel burner and furnace construction.

2. Description of the Prior Art

In the prior art, various furnace constructions having been advanced for burning solid fuel, including coal. Many have also used stepped burner grates, but the problems with complex drives, complex mounting, and inadequate movement of the grates have continued to limit their success. For example, in the prior art, a typical stoker-actuated coal burning apparatus is shown in U.S. Pat. No. 4,007,697 which utilizes a furnace cabinet having a burner with a rotating disk thereon. This shows a heat exchanger that provides for a curved path for the heated products of combustion and a separate burner blower.

U.S. Pat. No. 945,469 issued to Mapel on Jan. 4, 1910 shows a stepped grate in an automatic stoker apparatus wherein the grate assembly is mounted on wheels that can be moved in and out of the furnace, and includes a crank mechanism which has a double-acting lever arrangement to reciprocate the adjacent stepped grates in opposite direction when the crank rotates. However, the drive requires a complex lever system and the grate plates themselves are supported only on the lever arrangement, thus increasing wear on the actuating members, and tending to cause jamming and excessive loads in the heated, ash-filled environment in which the grates must work.

U.S. Pat. No. 1,644,953 issued to Seyboth on Oct. 11, 1927 is typical of a number of patents in the prior art which show a stepped grate where every other grate plate is fixed, and then the intermediate plates or bars forming the steps are driven to reciprocate. Very complex gear drives are utilized, and the grates are separated into sections for movement, resulting in the need for a large number of links, bell cranks, and levers.

U.S. Pat. No. 505,748 issued to Campbell on Sept. 26, 1983 shows a grate assembly that has a plurality of bars that are mounted on side plates and which interfit between stationary bars and reciprocate as a unit. The unit is mounted on roller-type bearings, and all of the movable grate bars thus reciprocate as a unit relative to the interfitting stationary bars.

U.S. Pat. No. 2,137,158 to Douglass issued Nov. 15, 1938 shows a "clinker cooling" arrangement using stepped grates and having reciprocating step members with a cooling fluid going through the plates. Every other grate bar is fixed. The unit is used primarily for cooling Portland cement clinkers.

U.S. Pat. No. 795,388 issued to Googins on July 25, 1905 shows a reciprocating terraced furnace grate, and in particular in FIGS. 9 and 11, the end edges of the grates are shown to be tapered. However, the grate bars also appear to be supported on lower rollers of car-type structures so that the grate bars on one of the cars interfit or interleaf with the grate bars of the other car, and then they are oscillated in opposite directions as they are used. The grate bar surfaces incline slightly downwardly.

U.S. Pat. No. 4,103,627 to Mainka issued Aug. 1, 1978 shows a grate construction which has reciprocal grate members made up into individual sections that are pivotally mounted to their supporting members. Some of the grate bars reciprocate relative to other grate bars.

The use of holes or openings through burner grates is also shown in the prior art, for example, U.S. Pat. No. 2,137,158 mentioned above, illustrates holes in the grates, but tapered in opposite direction from those disclosed in the present application. U.S. Pat. No. 1,403,609 issued to Leonard et al on Jan. 17, 1922 also shows reciprocating grates with tapered holes, but which are mounted in a substantially different manner than the present device. The grates in U.S. Pat. No. 1,403,609 do not reciprocate although pusher members are provided between the vertically spaced grates. U.S. Pat. No. 703,068 issued to King on June 24, 1902 illustrates a mechanism for driving sliding grate members from a type of feed auger, as does U.S. Pat. No. 2,119,937 issued to Banfield on June 7, 1938. In the Banfield Patent a rotating grate is driven from the stoker auger.

U.S. Pat. No. 527,453 issued to Richards on Oct. 16, 1894 shows a traveling floor furnace where there are elongated grate members which move, and which are inclined rather than stepped.

U.S. Pat. No. 804,457 issued to Cox on Nov. 14, 1905 shows an ash conveyor for furnaces which uses reciprocating stepped members, and U.S. Pat. No. 1,186,971 issued to Davis on June 13, 1916 shows a grate member that has plates that tilt under mechanical action to move materials.

U.S. Pat. No. 2,294,269 issued to Bennett on Aug. 25, 1942 shows a stepped, movable, water-cooled stoker having plates that slide relative to support shelves, but designed to include the water cooling for absorbing heat quickly.

U.S. Pat. No. 4,172,425 issued to Sheridan on Oct. 30, 1979 shows an incinerator that has movable members for transferring waste through the incinerator, but not a stepped grate construction such as the present invention, and U.S. Pat. No. 3,413,938 issued to Dvirka on Dec. 3, 1968 shows another form of a stepped grate member where the material is primarily moved by pushing grates against the material to cause it to move downwardly as it is burned.

The prior art, while showing a wide variety of stepped grates and furnace constructions, fails to teach or suggest a unit arranged with the stepped grate construction of the present invention in a furnace cabinet that provides for a high efficiency of air flow and heat exchange.

SUMMARY OF THE INVENTION

The present invention relates to a furnace construction for solid fuel burning, such as coal, including a furnace housing that is designed to maximize efficiency in heat transfer and preheating of the blower air including a stepped grate burner construction where the individual grate plates are reciprocated in opposite direction to the next adjacent plates to provide a thorough movement of the burning mass downwardly across the grate plates.

The grate plates are supported in a manner that eliminates excessive wear and jamming with ashes and clinkers, and yet requires low power consumption for the movement so that the grate unit can be operated from the drive used for supplying the solid fuel. In the form shown, a stoker auger is utilized for feeding coal to the burner, and the drive for the oscillation of the grate plates is from this stoker auger drive.

Each of the grate plates is individually supported on rolling washers which tend to be self-cleaning to prevent jamming or sticking of the plates, even under high temperature gritty and sooty conditions.

The plates are also designed with edges that prevent jamming along the side walls of the burner assembly, and they have apertures so that the burner air is forced upwardly through the grate plates to provide for efficient combustion of the solid fuel moving downwardly over the plates as the plates reciprocate.

The products of combustion pass through a heat exchanger assembly in the form shown which provides for a curved or tortuous path so that the air has to serpentine across surfaces that provide for heat exchange. Intake air ducts leading to the blower compartment carrying intake air to the blower pass through heated products of combustion to preheat the intake air and in general provide for additional efficiency with this preheating. Space in the combustion chamber which would normally be unavailable for direct heat exchange in any useful manner is thus made available by having the conduits carrying the blower intake air heated by the hot gases.

BRIEF DESCRIPTION OF THE DRAWINGS

FIG. 1 is a vertical sectional view through a furnace made according to the present invention including a stepped reciprocating grate for solid fuel burning also made according to the present invention;

FIG. 2 is a top plan view of the device of FIG. 1 with parts in section and parts broken away;

DETAILED DESCRIPTION OF THE PREFERRED EMBODIMENTS

Figure 3:
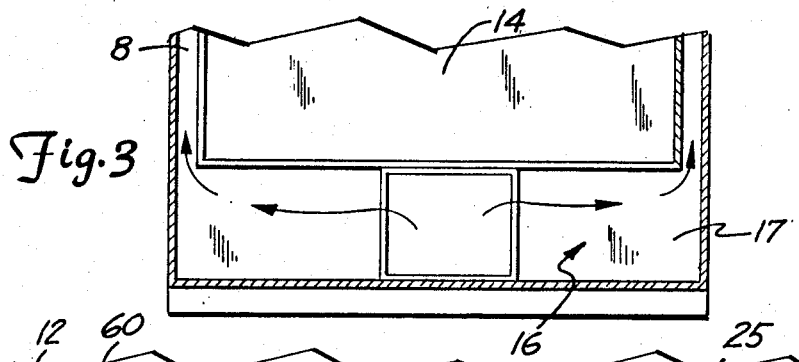
FIG. 3 is a framentary sectional view taken generally along line 3—3 in FIG. 1.

In FIG. 1 a furnace indicated generally at 10 includes an outer jacket 11, which surrounds enough of the furnace so that adequate heat exchange is made with the hot outer bodies of the inner burner housing 12.

The exact construction of the outer jacket is a matter of desired design, the exact details of the passageways and the like are not shown in any detail in that they can be of any desired type. A hot air plenum 9 is thus formed between the housings 11 and 12 which supplies air to ducts, such as duct 8, which leads to the building heat ducts.

The inner burner housing 12 as shown includes a plurality of walls and a divided into two main compartments, including an intake or return air chamber 13 that is formed with a slanted wall 14 dividing the fire box or burner chamber 15 from the compartment or chamber 13. Additionally, the return air plenum chamber 13 is separated from a blower outlet passageway 16 leading to chamber 9 with a vertical wall 17 that has an opening for the outlet of a blower 18 of conventional design. Blower 18 is mounted in the plenum chamber 13 and is driven with a suitable motor 19. The blower outlet opens into the chamber 16, and chamber 16 is open ends to the hot air or supply plenum 9 formed between the outer wall 11 and the burner housing wall 12, as shown in FIGS. 1 and 3.

The chamber 15 as shown includes a burner assembly 25 adjacent one wall, and a suitable access opening 26 that can be in any form desired, and in addition, an inclined partition or flow control wall 30 is mounted between the opposite side walls 12A and 12B of the burner compartment, but is spaced upwardly from the bottom wall. The lower wall 12C of the burner compartment is flat and wall 14 intersects and is sealed to the lower wall 12C so that the blower outlet is sealed from the burner chamber 15.

Divider wall 30, as shown schematically, forms a path for heated products of combustion from the burner 25, indicated by the arrows 31 which will go directly upwardly from the burner, and then curve downwardly to the lower side of the divider wall 30, and then up through a portion 15B of the chamber 15 closed off by the upper wall 12E of the burner chamber through a stack 33 leading in a suitable manner to the exterior of the building. The stack is surrounded by an intake air duct 34 that has suitable walls 35 that surround the stack 33. The stack passes out through the walls 35, and is sealed with respect to these walls. The intake air duct 34 opens to a source of intake air, such as a return plenum or return ducts from a building to be heated. The return air duct 34 is closed off from the passageway 23 with suitable wall members, but opens to the upper surface of the upper wall 12E of the burner compartment. As shown in FIG. 2, the upper wall 12E, which is partially broken away in FIG. 4, has a pair of ducts that have triangular shaped cross sections as and are indicated at 40 and 41, respectively. These openings are the ends of walls forming triangular intake ducts which, as shown in FIG. 1, pass through the second porition 15B of the heated chamber 15 carrying the products of combustion and are sealed therefrom and then opened through suitable openings in the plate 14 to the plenum chamber 13. The ducts 40 and 41 are also sealed with respect to the plate 14 around their perimeter, but open through the plate 14 so that air indicated as flowing by the arrow 44 will pass through these ducts and into the plenum chamber 13. The intake air then will be taken into the blower 18 in a normal manner and exhausted out through the passageway 16 to plenum 9 around the heat exchange chamber comprising the walls 12 of the burner housing 12 and then out through duct 8 from the chamber 9 through the outer wall of the housing 11 in a normal manner.

An ash auger 46 is positioned in the burner compartment and is accessible and operable from the exterior of the furnace for removing ashes that drop to the bottom of the furnace chamber. If desired, other vertical divider walls also can be used in the heat exchange chambers for forming longer paths to be made for the products of combustion before they are exited through the stack 33.

As shown in FIG. 1, a suitable coal stoker auger 51 is provided from a coal source, illustrated only schematically at 50 in FIG. 1, will auger coal through a screw conveyor tube 52 is is provided for feeding material to the burner assembly 25, and a blower 53 can be provided for combustion air through a suitable duct 54 to the interior of the burner housing.

Additionally, as will be explained, a drive link is connected to the motor indicated at 56 that is used for driving the coal stoker auger to provide reciprocal motion of the burner plates as will be explained.

Figure 5:
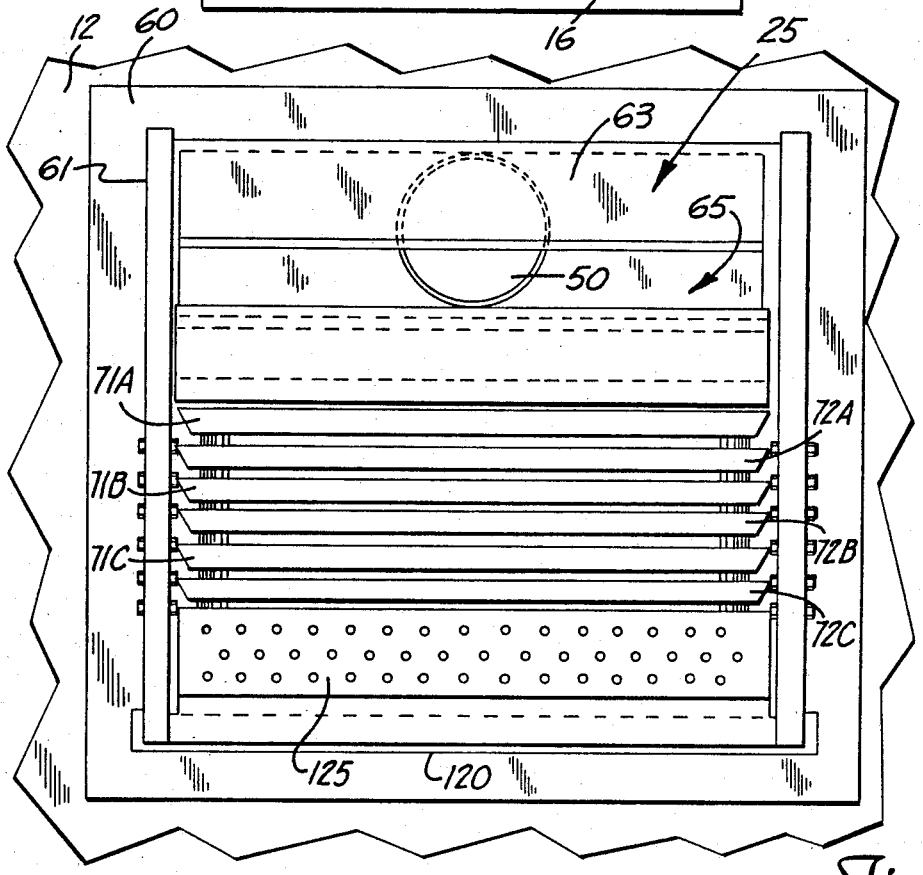
FIG. 5 is a front elevational view of the device of FIG. 4.
Figure 4:
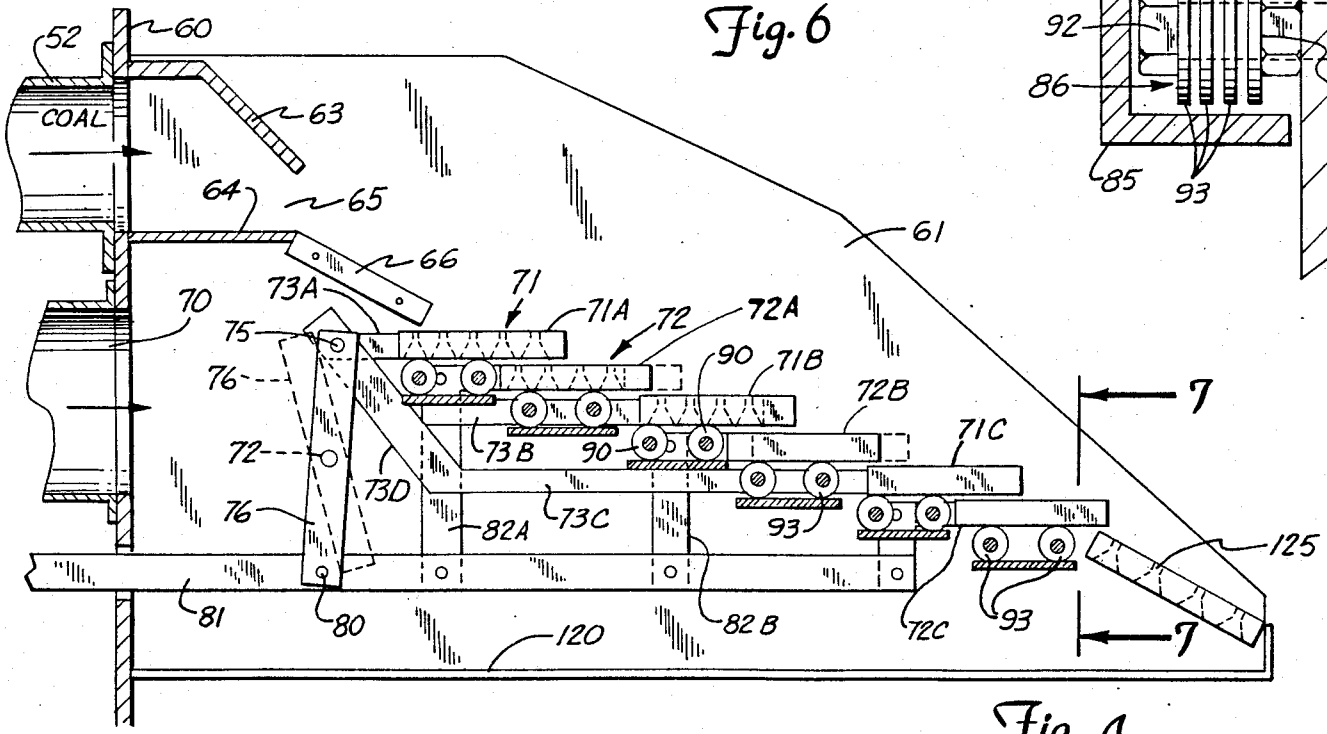
FIG. 4 is a side elevational view of a burner assembly used with the furnace of the present invention showing the grate plates drive arrangement with one of the side plates removed.

Referring specifically to FIGS. 4 and 5 in particular, the burner assembly indicated generally at 25 is shown. The burner assembly includes a backing plate 60 that is made to fit into an opening in the front plate of the burner housing 30 in a suitable manner and be supported thereon. The burner assembly 25 further includes a pair of side plates 61, 61 which are spaced apart as shown in FIG. 5, and form side plate guides for a stepped grate assembly indicated generally at 62. The coal auger housing 52 opens through the front plate 60 and discharges coal against a guide deflector plate 63 and through an opening 65 defined by the plate 63 that overlies the opening of the auger. The plate 63 extends all the way between the side plate 61 so that as the material comes in from the round opening of the auger it tends to spread out along a support shelf 64.

The plate 63 as shown restricts the opening from the auger in vertical height relative to the plate 64. The plate 64 also extends between the side plate 61 so that the restricted opening 65 spreads coal out along substantially the entire width of the burner between the side plates 61. A fixed first grate plate 66 joins the shelf or plate 64 and forms an inclined surface over which the coal coming from opening 65 will slide onto the uppermost portion of the movable grate assembly 62.

Also as shown, the air intake opening indicated at 70 is connected to the blower combustion air duct so that air comes in underneath the shelf 64 (which is solid, that is, with no air holes) and the plate 62 so that the air is directed toward the movable grate assembly 62.

The grate assembly 62 is made up of a plurality of three or more grate plates in order to give the necessary vertical height and also proper operation of the plates. As shown, there are two sets of grate plates, each with three plates. A first set of grate plates is indicated generally at 71 and includes plates 71A, 71B and 71C. These plates 71A, B and C are all made so that they are independently supported on the side plate 61 as will be explained, and also are fastened together so that they will be reciprocated simultaneously with each other.

Figure 6:
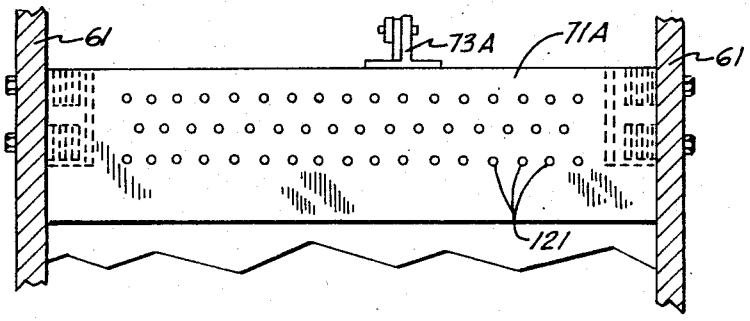
FIG. 6 is a fragmentary top plan view of a typical step plate for the grate of the present invention.

A second set of grate plates indicated at 72 comprise plates 72A, 72B and 72C. These plates 72A, B and C are interleafed with the plates 71, and are also supported independently, as will be explained. The plates 71A, B and C each have a link attached thereto at the rear edges and in the center portions of the plates, as shown in FIGS. 4 and 6. The plate 71A has a link 73A attached thereto; the plate 71B has a link 73B attached thereto; and the plate 71C has a link 73C attached thereto. The link 73C has an upwardly inclined portion indicated at 73D, which is aligned with and is fixed to the end of the link 73B as shown. The link portion 73D extends upwardly toward the link 73A as shown, and the link 73A and the link portion 73D are mounted with a common pivot pin 75 to a pivoting lever 76 that is pivotally mounted on a suitable pivot pin 77 that is fixed to the side plates 61. The pin 77 may be suitably supported in brackets on the side plates 61 to carry the loads during operation.

The lever 76 has a portion which extends downwardly from the pivot pin 77 and is pivotally mounted with a suitable pin 80 to an elongated drive link 81. The pivot pins 77 and 81 can be provided with suitable bushings that will withstand high temperatures as needed.

Each of the grate plates in the second set 72 also is provided with drive links. The plate 72A for example, has a link 82A attached thereto at the rear side and extending vertically downward and is fixed to the link 81. Likewise, the link 72B has a link 82B attached thereto with a vertical portion fixedly connected to the drive link 81.

The plate 72C has a link 82C attached thereto and also fixedly attached to the end of the drive link 81 so that these links 82A, 82B and 82C move directly with the drive link 81.

The plate sets 71 and 72 are each individually supported in the manner shown in FIG. 6, where the plate 72C is shown typically.

Each of the plates, at its opposite ends, as shown, has a beveled or tapered end surface 84, the upper edge of which is closely spaced from the adjacent side plate 61. The edge surfaces provide a cleaning action as the plates move relative to the side wall 61 so that things will not jam down into the space between the plates on the side walls. Additionally, each of the plates at each of its ends has a retaining track formed in the shape of an angle iron, indicated at 85, welded thereto, so that the lower leg of the angle extends to form a track receptacle 86.

The side walls 61 are provided with support shafts or bolts clamped to the side plates 61 and indicated at 90. These bolts 90 have end portions extending under the grate plates and in the form shown are clamped to the side walls 61 with a nut 91 threaded thereto to clamp the bolt tightly. The bolts have a shank portion having a head 92. A plurality of spaced, disc washers 93 are rotatably mounted on the shaft portion of each of the bolts and are indicated at 93 in FIG. 6. The washers are of a size so that they will rotate on the bolts and form roller supports for the grate plates. There will be some space between the washers as shown. They are free to rotate on the shaft portion of the respective bolt 90.

Each end of the grate plates contacts and is supported by two of the sets of washers or rollers, as shown in FIG. 4, so that the plates will roll on the washers and be stably supported throughout the reciprocal movement of the grate plates.

Figure 8:
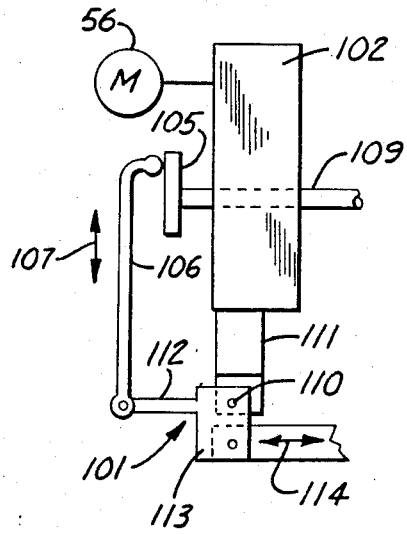
FIG. 8 is a fragmentary side elevational view of a typical drive link schematically shown for operating the device of the present invention.

The drive link 81 extends out of the burner compartment to a reciprocating bell drive indicated at 101 in FIG. 8 partially schematically. The reciprocating drive may be of any desired type, but as shown it is driven from a gearbox 102 that is driven with the motor 56 used to rotate a shaft 104 which is coupled to drive the stoker screw conveyor or auger 51 used for conveying coal (or other fuel) to the burner. The motor 56 drives the gears in the gearbox 102 and rotates the shaft 104 in conventional manner. The gearbox output shaft 104 also has an end 104 which extends out through the gearbox wall. The shaft 10 is mounted on suitable bearings in the gearbox in a conventional manner and the end 104A opposite from the auger 51 has a crank arm 105 at its outer end. The crank arm 105 has a crank pin which mounts a connecting rod 106 that will reciprocate up and down in direction indicated by arrow 107 as the shaft 104 rotates. The reciprocating drive 101 as shown includes a bell crank 108 which is pivoted on a pivot pin 110 to a support member 111 connected to the gearbox 102. The bell crank 108 has an outwardly extending actuator arm portion 112 that is pivotally connected to an opposite end of the connecting rod 106 from the crank 105. Rotation of the crank 105, and the reciprocation of the connecting rod 106 will cause the lever 112 to move up and down, and the end portion 113 of the bell crank will pivot around the pivot pin 110 to move back and forth generally as indicated by the arrow 114. This in turn will reciprocate the drive link 81, and the movement of the drive link 81 will cause movement of the second set of grate plates 72 in a first direction as the drive link moves back and forth, as indicated by the arrow 114 in FIG. 4, and at the same time the lever 76 will be pivoted by the drive link portion 81 about the pivot pin 77. This means that when the drive link 81 is moving in direction away from the burner support plate 60, the upper end pin 75 on the lever 76 will be moving in the opposite direction from the link 81, causing the links 73A, 73B and 73C to be moved in opposite direction from the link 81 and thus in opposite direction from the grate plates 72A, 72B and 72C. The grate plates 71A, 71B and 71C thus move oppositely from the second set of grate plates 72. Then when the bell crank 108 starts to move in the reverse direction, the second set of grate plates 72 will move directly with the link 81 and the first set of grate plates 71 will move in opposite direction to give a countermovement of the adjacent grate plates of the grate assembly and cause the solid fuel on the grates to be agitated as it burns.

In the opposite position of lever 76, shown in dotted lines in FIG. 4, the grate plates will still overlap along their edges so that there will not be any space for material to fall downwardly into the plenum chamber underneath the grate plates.

Figure 7:
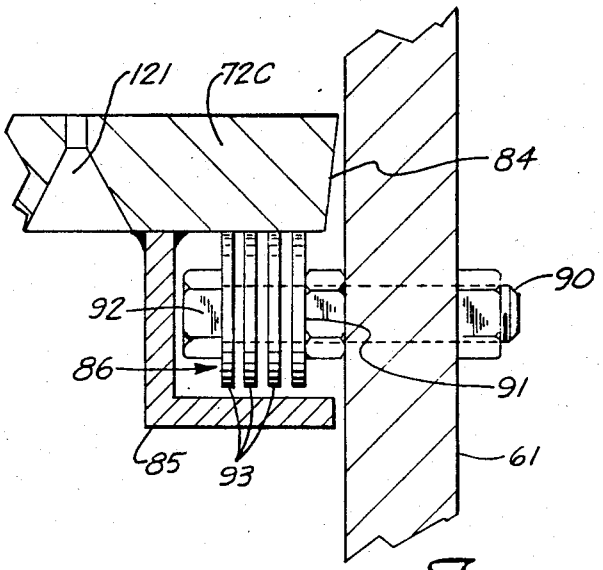
FIG. 7 is a fragmentary enlarged sectional view taken along line 7—7 in FIG. 4 showing a typical support arrangement for the device of the present invention.

The burner assembly 25 has a bottom plate 120 that closes off the chamber below the grate plates so that the combustion air will be forced upwardly through the openings in the plates 71 and 72, which are indicated typically in FIG. 7 at 121. As shown in FIG. 6, the openings 121 are tapered in narrowing direction from the bottom surface of the respective plates upwardly to provide for the ability of any materials that tend to pass through such openings on the top of the grate plate to fall through, if it gets through the upper end of the openings on the top surface of the plate. This prevents jamming, and also aids in air flow as the venturi effect tends to increase the velocity of the air through the openings 121 at the narrower end which is at the top surface.

The bottom plate 120 extends in fore and aft direction along the side plates 61, and at the outer or lowermost end of the grate assembly 65 there is a fixed transfer plate 125 that extends between the side plates 61 and has openings therethrough as well, across which the burned materials will slide down into the ash receptacle at the bottom so that the auger can be used for conveying these ashes outwardly.

The burner grate assembly provides a unique burning operation in connection with the overall furnace, to ensure that adequate combustion is done efficiently, and with little problems with clinkers and residues in the burner compartment.

The time allowed for movement of the material over the stepped grate plates is kept sufficiently high so that adequate combustion takes place, and while the device is simply and easy to use, it ensures that clinkers will not form and that any ashes and other materials will be agitated sufficiently and moved down into the ash receptacle.

The grate plates move relatively slow and reciprocate about two or three times per minute, so the amount of movement is not a problem.

Although the present invention has been described with reference to preferred embodiments, workers skilled in the art will recognize that changes may be made in form and detail without departing from the spirit and scope of the invention.

What is claimed is:

1. A hot air furnace for burning solid fuel comprising:

a furnace cabinet having walls defining a first furnace burner chamber;

a heat exchanger in heat conducting relation to the first chamber and having a heated air outlet;

wall means defining a second chamber, including an inclined wall extending diagonally upwardly and across the first burner chamber from one side wall to the other;

a blower in the second chamber having a discharge opening leading to the heat exchange passageway and an intake open to the second chamber;

at least one baffle in the burner chamber forming a third chamber portion overlying the diagonal wall and defining a serpentine path for products of combustion into the third chamber portion;

a discharge stack leading from the third chamber; and intake air duct means formed through said third chamber and having outer surfaces open to the third chamber and opening through the diagonal wall to the second chamber for permitting intake air for the blower to be taken from outside of said furnace into the second chamber.

2. The apparatus as specified in claim 1 wherein said second chamber is formed below the third chamber portion, and said intake air duct means extends above the furnace compartment and defines a conduit surrounding the discharge stack.

3. The apparatus as specified in claim 1 wherein said diagonal wall inclines upwardly from the bottom of the furnace cabinet, and the upper surface of the diagonal wall being open to the third chamber portion, said second chamber thereby being formed below the third chamber portion, and said intake air duct means defining an air inlet plenum above the furnace cabinet.

4. A hot air furnace for burning solid fuel comprising:

a furnace cabinet having walls defining a first furnace burner chamber;

a heat exchange passageway in heat conducting relation to the first chamber;

wall means defining a second chamber;

a blower in the second chamber having a discharge opening leading to the heat exchange passageway;

at least one baffle in the burner chamber forming a third chamber portion and defining a serpentine path for products of combustion into the third chamber portion;

a discharge stack leading from the third chamber; and intake air duct means formed through said third chamber and having outer surfaces open to the third chamber for permitting intake air for the blower to be taken from outside of said furnace cabinet into the second chamber, said second chamber being formed below the third chamber portion, and said intake air duct means extending above the furnace cabinet and defining a conduit surrounding the discharge stack.

5. The apparatus of claim 4 and a solid fuel burner mounted in said first furnace burner compartment.

6. The apparatus of claim 5 wherein said solid fuel burner comprises a plurality of vertically stacked stepped grate plates, means to support said grate plates for generally transverse movement parallel to the planes of said grate plates, and drive means to drive said grates in a reciprocal movement, so that adjacent grate plates move in opposite directions from each other.

* * * * *